US005310279A

United States Patent [19]

Lindner

[11] Patent Number: 5,310,279

[45] Date of Patent: May 10, 1994

[54] PAVEMENT MARKERS WITH FRANGIBLE INSTALLATION TABS

[75] Inventor: Henry Lindner, Elgin, Ill.

[73] Assignee: Elgin Molded Plastics, Inc., Elgin, Ill.

[21] Appl. No.: 978,866

[22] Filed: Nov. 19, 1992

[51] Int. Cl.[5] ..... E01F 9/04

[52] U.S. Cl. ..... 404/14; 404/16

[58] Field of Search ..... 404/12, 14, 15, 16

[56] References Cited

U.S. PATENT DOCUMENTS

| | | | |
|---|---|---|---|
| 2,065,314 | 12/1936 | Johnson | 404/16 |
| 3,343,467 | 9/1967 | Bonvallet | 404/16 |
| 3,427,933 | 2/1969 | Taylor-Myers | 404/9 |
| 3,499,371 | 3/1970 | Junnes et al. | 404/9 |
| 4,088,416 | 5/1978 | Taylor | 404/15 |
| 4,129,397 | 12/1978 | Eigenmann | 404/14 |
| 4,189,209 | 2/1980 | Heasley | 404/14 X |
| 4,402,628 | 9/1983 | Grenier et al. | 404/16 |
| 4,557,624 | 12/1985 | Walker | 404/14 |
| 5,078,538 | 1/1992 | Montalbano | 404/14 X |

FOREIGN PATENT DOCUMENTS

| | | | |
|---|---|---|---|
| 4112702 | 10/1992 | Fed. Rep. of Germany | 404/14 |
| 733020 | 9/1932 | France | 404/15 |

*Primary Examiner*—Mark Rosenbaum
*Assistant Examiner*—Frances Chin
*Attorney, Agent, or Firm*—Olson & Hierl, Ltd.

[57] ABSTRACT

Pavement markers are provided that are equipped with installation tabs which permit marker storage vertically and which permit hand holding of the individual markers during installation. After a marker is installed, each tab is breakable adjacent to the marker upper surface in response to an applied small bending force. The tabs overcome the problem of installing pavement markers upon hot tar.

18 Claims, 1 Drawing Sheet

PAVEMENT MARKERS WITH FRANGIBLE INSTALLATION TABS

FIELD OF THE INVENTION

This invention lies in the field of pavement markers which are equipped with installation tabs.

BACKGROUND OF THE INVENTION

Pavement markers which have convexly rounded upper surface portions and convexly extending perimeters have come into general usage particularly for use in vehicular lane marking. For example, by placing a series of markers upon the center line of a two-lane paved road with the markers being longitudinally spaced from one another, improved ability is provided for a vehicle driver to stay in his assigned proper lane is provided. A vehicle driver traveling in either direction either sees the markers or senses the vibration when tires of his vehicle strike individual markers successively. At least some of the pavement markers of a center line located series can each be associated with retro-reflective reflector means for viewability by approaching vehicle drivers during nighttime.

At the present time, pavement markers are installed manually. Each individual pavement marker of a series is positioned by hand and is conveniently adhered to a paved road surface at a desired location and oriented position by means of an adhesive. A presently commonly used adhesive is hot tar during installation.

The convexly rounded upper surface portions of a pavement marker cannot be held by an installer's hand since no gripping surface exists. For an installer to hand hold a pavement marker along opposed portions of its opposite edges is dangerous because of the potential for finger and/or thumb burns from exposure to the hot tar during final positioning and contacting of an individual pavement marker with freshly deposited hot tar during installation.

There is a substantial need in the art of pavement markers for a system or means for manually holding an individual pavement marker in such a way that the chance of injury to an installer's hand is substantially eliminated.

BRIEF SUMMARY OF THE INVENTION

This invention relates to pavement markers with generally convexly rounded upper surface portions which are initially provided with digitally graspable, integrally associated, frangible installation tab means.

The tab means permits an installer to use his hand safely to pick up, move, position and deposit such a pavement marker upon and into a localized deposit of hot tar or like adhesive at a site on pavement whereat the marker is to be located and installed.

After installation, the tab means is readily broken away at the rounded upper surface leaving only a slight, almost imperceptible imperfection thereon of no adverse consequence to the usage or the appearance of the resulting pavement marker.

A pavement marker that is so equipped with such tab means can have any desired or convenient number of tabs and any desired or convenient marker configuration. However, a present preference is to employ a pair of tabs and a pavement marker body having a convexly curved perimeter, and, most preferably, a round configuration. Also, an inventive pavement marker preferably has a generally planar bottom face which is provided with surface irregularities for augmenting bottom bondability to an adhesive.

A tab equipped pavement marker of this invention is also easily stored and shipped after manufacture and before installation because a plurality of such markers can be vertically stacked one on the other with the tabs functioning to stabilize the super adjacent marker and to prevent damage to markers by scratching or the like.

The generally convexly rounded upper surface of a pavement marker is preferably continuous in curvature except for areas thereof wherein a reflector means is optionally associated. Preferably, such a reflector means is retro-reflective and lenticular, and is inset into such rounded upper surface.

The body of a pavement marker is fabricated of relatively rigid moldable materials. Plastic, metal or ceramic materials are usable. A reflector if incorporated into a marker is fabricated of transparent plastic.

A preferred pavement marker of this invention has a solid body that is equipped with either one or two inset retro-reflective lenticular reflector.

Other and further objects, aims, purposes, features, advantages, embodiments, variations and the like will be apparent to those skilled in the art from the present teachings taken with the appended drawings and associated claims.

DETAILED DESCRIPTION

Figure 3:
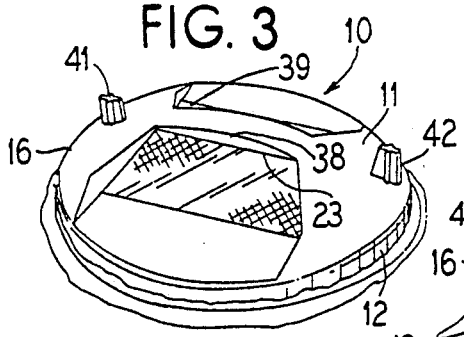
FIG. 3 is another perspective view of the marker shown in FIGS. 1 and 2 but showing the marker after implacement and the installer's hand has been removed.

Those skilled in the art will appreciate that a pavement marker of this invention can have various desired configurations or shapes. However, a present preference is to employ a pavement marker whose body has a solid, opaque, flattened configuration. The body preferably has a generally continuously curved (or convexly rounded) upper portion and a generally convex perimeter which has an oval, or more preferably, circular configuration. Preferably also, the pavement marker body has a generally flattened or planar bottom face.

Referring to the drawings, there is seen in FIGS. 1-5 an embodiment 10 of a presently preferred pavement marker of this invention. The pavement marker 10 has a generally convexly rounded upper surface 11 whose facial curvature is preferably comparable to that of a spherical segment. Also, marker has a generally circular perimeter edge or side 12 which upstands somewhat from the periphery of a bottom face 13 and which extends at a slight upward inward angle of inclination (not shown in the drawings) relative to the pavement marker 10 central vertical axis 14 (shown as a point, for example, in FIG. 4). Such slight angle of side inclination can vary as desired, but is conveniently and preferably in the range of about 0.4° to about 2.5° with respect to the vertical. This inclination angle is provided not only to enhance the ease with which a vehicular tire (not shown) can commence a roll over surface 11, but also to enhance the ease of removal of a reflector body portion that includes the surface 11 and the integrally formed edge 12 from a mold. The corner 16 between the edge 12 and the surface 11 is preferably rounded or beveled (not shown in the drawings) for similar reasons.

Typically, the side 12 of a pavement marker 10 extends upwardly from the bottom 13 and the pavement surface 47 upon which marker 10 is mounted a short distance, and the rounded upper surface 11 is configured so that a vehicle tire readily rolls thereover. For example, maximum pavement marker 10 height is preferably along center axis 14 and this height is commonly and preferably in the range of about one to about three centimeters.

The diameter of a pavement marker 10 can vary. A present preference is to provide a diameter that is in the range of about 5 to about 15 centimeters, but larger and smaller radii can be employed, if desired. Preferably marker 10 has a solid body that defines the top surface 11, edge 12 and bottom 13.

Although pavement marker 10 has a generally flattened or planar bottom face 13, for ease of accurate mounting and adherence to adhesive means, the bottom face 13 is preferably provided with surface irregularities, such as an open waffle design or the like. To eliminate air entrapment and improve the adhesive bonding of the marker 10, the bottom face 13 is here preferably provided with a plurality of spaced, shallow, discretely formed projecting feet 17.

The generally convexly rounded upper surface 11 of pavement marker 10 is preferably continuous and preferably has a smooth or uniform curvature except for areas thereof which may be associated with reflector means. Reflector means is optionally incorporated into a pavement marker so that the pavement marker 10 is reflective, preferably retro-reflective, in response to incident light striking a pavement marker from approaching vehicular headlights at night.

While a reflector means that is associated with a pavement marker 10 can be located on, or recessed in, the rounded upper surface 11, it is presently preferred to have a lenticular prismatic retro-reflective reflector located in one or two localized areas of the rounded upper surface 11. When two such areas are provided, it is preferred that each be generally opposed to the other and located on opposite sides of the surface 11 of pavement marker 10 for retro-reflectivity in opposed directions. In general, when such a lenticular reflector is associated with a pavement marker 10 upper surface 11, the reflector is retro-reflectively effective within a predetermined small included vertical angle relative to and extending upwardly from the horizontal (or assumed) surface of the road), and also within a predetermined small included horizontal angle relative to either side of a hypothetical horizontal center line extending through a reflector perpendicularly to a reflector center line running across the planar face of such a reflector.

A planar-faced, prismatic, lenticular, reflex-reflective member as mounted in a pavement marker body preferably is retro-reflective of incident light originating within an effective projected vertical reflex angle that extends from about a horizontal ground line upwards to a maximum vertical angle that is not more than about 0.5 degrees and preferably is about 0.2 degrees. Also, such reflective lens-like member as so mounted is retro-reflective of incident light originating within an effective projected horizontal reflex angle that extends at least about 1 degree on either side of a horizontal line that extends perpendicularly through a center line that extends horizontally across the planar face of such member. In the case of pavement marker 10, this horizontal line corresponds approximately to a diameter of the body of marker 10.

Owing to the nature, structure, and operation of a prismatic lenticular retro-reflective reflector, it is common to achieve such retro-reflective viewability angles using a retro-reflective reflector which is comprised of clear plastic which has a flat (or planar) smooth front face behind which are positioned (by molding in clear transparent plastic) hexagonal retro-reflective elements. The nature and construction of such a flattened retro-reflective reflector element is well known in the art and lenticular reflectors incorporating such elements are believed to be commercially available. Such a retro-reflective reflector is preferably inset into the profile of the pavement marker top convex surface, and, as mounted in such surface, is canted or angularly inclined. Preferably such an inset reflector has perimeter portions which are overlapped slightly by adjacent portions of the top surface 11 for holding and sealing purposes. Preferably, the pavement marker body is opaque as distinct from the clear (transparent) body of the reflector itself. The reflector can also be colored such as yellow, red, blue, green or the like.

In a pavement marker 10, two flat retro-reflective reflectors 18 and 19 are utilized which are each inset into the upper surface 11 and located in symmetrical, opposed relationship to one another on diametrically opposed sides of center axis 14 between axis 14 and edge 12. Each reflector 18 and 19 is provided with a trapezoidal perimeter configuration with the respective elongated straight base 21, 22 being adjacent edge 12, and the respective elongated shorter straight apex 23, 24 being adjacent axis 14. The opposite side chords 26, 27 and 28, 29 of each respective reflector 18 and 19 are suitable for achieving the desired inset position of each reflector 18 and 19 relative to rounded upper surface 11 (see FIG. 4, for example).

Because the inclination angle of the front planar face of each reflector 18 and 19 is somewhat greater than the curvature associated with upper surface 11 in pavement marker 10, the base 21, 22 of each reflector 18, 19 is radially inset from the adjacent portions of edge 12. To avoid impairment of the desired horizontal vertical viewability angle for 32 each reflector 18, 19, the body region 31 and 32 between each base 21, 22 and adjacent portions of edge 12, respectively, is flattened and extends generally horizontally.

The body regions 33, 34 along and forwardly of each side chord 26, 27 and also the region 38 above the reflector 18, and the corresponding regions 36, 37 along and forwardly of each reflector side chord 28, 29 and also the region 39 above the reflector 19, are slightly angled (with respect to the vertical) so as not to interfere with reflector viewability. Beveled edges are preferably provided (not shown in the drawings) to provide a smooth adjoining inter-connections between such regions and the surface 11 and also the edge 12.

In accord with this invention, the generally convexly rounded upper surface of a pavement marker, such as pavement marker 10 or the like, is provided with tab means, such as a pair of upstanding tabs 41 and 42. In marker 10, tabs 41, 42 are each located and based preferably on the surface 11 so as to be in spaced, adjacent relationship to the edge 12 of the marker 10 and also to the center 14 of the marker 10. For reasons of easy balance when a marker 10 or the like is supported by such tab means, the pair of such tabs 41 and 42 is located preferably along or on either side of a (hypothetical) diametrical line (not shown) that passes through the approximate center 14 of the marker 10. In marker 10, this line preferably corresponds to a diameter that extends mid-way between the apexes 23 and 24 and also is perpendicular to another hypothetical diametrical line that extends perpendicularly through a facial center line on each of the respective reflectors 17 and 18.

The individual tabs of a marker, such as tabs 41 and 42, can have various configurations consistent with their desired moldability with upper surface 11. Preferably the tabs 41 and 42 are each unitarily molded and formed concurrently with the rounded upper surface 11 of a pavement marker 10 at the time of marker body formation.

For reasons of providing convenient, controllable frangibility or breakability of the tab means preferably at the bottom thereof adjacent surface 11 after pavement marker installation, it is now preferred to have each individual tab such as tabs 41 and 42 be uniformly elongated in tab width (relative to a diameter of marker 10) compared to tab breadth (relative to a circumference of marker 10) particularly at the location on the upper surface 11 where a tab upstands or projects. For reasons of moldability, such elongation in tab width preferably lies generally along a diameter in marker 10.

Figure 1:
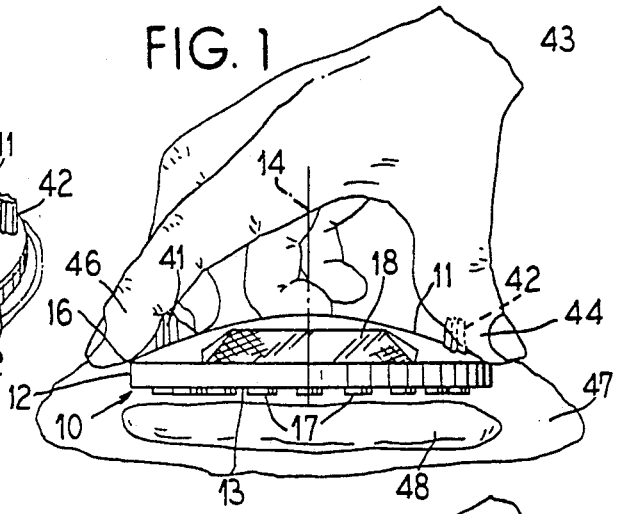
FIG. 1 is a perspective environmental view showing one embodiment of a reflectorized pavement marker of the present invention that is being hand held and positioned over a dollop of hot tar.
Figure 4:
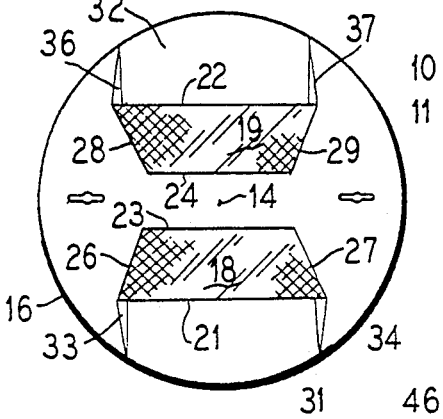
FIG. 4 is a top plan view of the marker shown in FIGS. 1-3.

For reasons of providing digitally engagable tab outer end portions, each individual tab 41, 42 is preferably relatively blunt ended yet such outer end portions are preferably elevated above the rounded marker surface 11 to an extent such that an installer's hand 43 using only the forefinger tip and a thumb tip regions 46 and 44, respectively, can engage the outer end portion of each one of the pair of tabs 41, 42 of the pavement marker 10 and thereby support the marker 10 with compressive force exerted between the thumb and forefinger the marker 10 preferably without contacting the adjacent rounded surface portions 11 (see FIG. 1). Each tab 41 and 42, however, is also breakable adjacent top 11 responsive to a relatively small bending force applied against a top outer region in a different direction from that in which such compression force is exerted. In the marker 10, this bending force is exerted or applied preferably normally (that is generally circumferentially relative to the body of marker 10) in contrast to the direction the compression force is applied (that is, generally radially relative to the body of marker 10).

Figure 7:
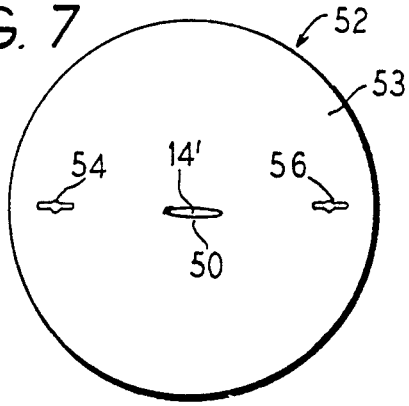
FIG. 7 is a view similar to FIG. 4 but showing an alternative embodiment of a pavement marker.

In place of a pair of tabs, such as tabs 41 and 42, a single tab 50 shown in phantom in FIG. 7 can be employed that is located, for example, across axis 14' on surface 11 and which is sized so as to be graspable by the thumb and forefinger of the installer's hand. Also, in place of tabs 41 and 42, three equally circumferentially placed tabs can each be employed, if desired (not shown) which can be contacted by individual ones of each of a thumb and two fingers for marker grasping, lifting and positioning purposes. Various tab means thus can be employed.

Figure 2:
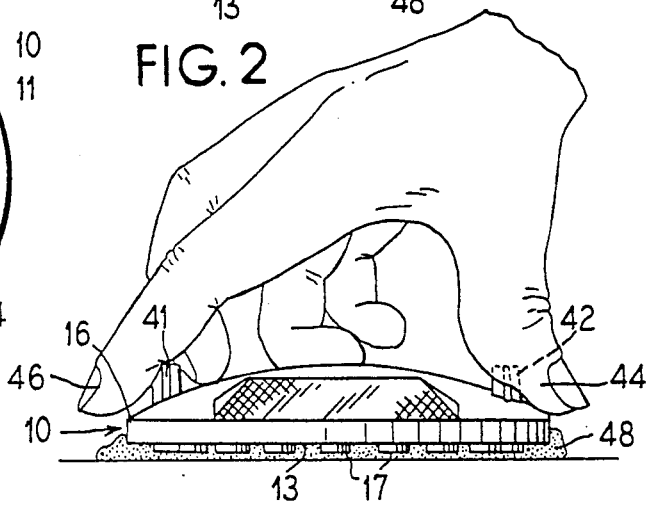
FIG. 2 is a view similar to FIG. 1, but showing the hand held marker immediately after implacement against the hot tar.
Figure 5:
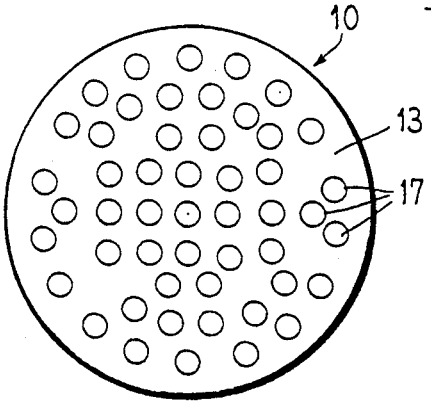
FIG. 5 is a bottom plan view of the marker shown in FIGS. 1-4.

To install a pavement marker 10 upon a road pavement or the like, and in accord with usual contemporary commercial practice, one deposits at a predetermined location on pavement 47 a dollop 48 or quantity of hot, liquified tar. The amount of tar in the dollop 40 is preferably at least about sufficient to cover the bottom face 13. Such hot tar reportedly has a temperature in the range of about 190° to about 230° C. Before such tar dollop 48 has a chance to cool appreciably, the installer picks up a pavement marker 10 and holds same by and between the tabs 41 and 42 using the thumb and forefinger tip regions 44 and 46 of one hand 43. He then moves the so held marker 10 to a position over and adjacent to the tar dollop 48, and he orients this marker 10 with his hand 43 so that the marker 10 and its reflectors 18 and 19 are positioned and oriented as desired, as shown in FIG. 1. He then deposits the marker 10 upon the hot tar dollop 48 and preferably pushes downwardly to impress the bottom face 13 and feet 17 into the dollop 48 as shown in FIG. 2. Finally, he releases the marker 10 from his hand 43 before heat from the tar dollop 48 can cause harm or discomfort to his hand 43 whereupon the marker 10 has the appearance generally shown in FIG. 3. The tabs 41 and 42 make possible the simple, effective, accurate and safe installation of the pavement marker 10.

If the installer desires, the tip regions 44 and 46 of his thumb and forefinger can extend beyond the tabs 41 and 42 and rest against adjacent surface portions of the upper surface 11, as shown in FIGS. 1 and 2. Also, other fingers of the same hand can rest against portions of the upper surface 11 or of a reflector 18 or 19 for stabilization reasons, as those skilled in the art will appreciate.

After installation, the tabs, such as tabs 41 and 42, are readily broken away from the upper rounded surface such as surface 11 by a relatively small applied bending force. The shape and configuration of the tabs is such that breakage at the level of the upper surface 11 occurs as compared to breakage along the length of a tab. Thus, tabs such as tabs 41 and 42 that are configured so as to be elongated in height and of uniform, thin construction so break at their base. Breakage force can be applied in any one of many ways, including finger pressure (perhaps by the installer after installation), hammer tapping, vehicle tire, such as the first tire after installation which rolls over the pavement marker 10, or the like. After tab breakaway, characteristically only a slight almost imperceptible imperfection remains upon the surface 11. This imperfection has no known adverse effect or consequence regarding usability, usage or even appearance of the resulting pavement marker.

As those skilled in the art will appreciate, a pavement marker, such as marker 11 or the like, can have any convenient or desired composition or structure. Any convenient, moldable material can be used. However, moldable materials such as plastic, metal or ceramic are convenient with plastic being presently preferred.

Various marker fabrication procedures can be used as those skilled in the art will appreciate. An advantage of this invention is that the known fabrication procedures generally can be used, if desired, with only slight mold preliminary changes. One fabrication procedure for use with plastic is to first mold the upper surfaces 11 and associated edge 12 with the regions 31–34 and 36–39 being included. Then, reflectors 18 and 19 are positioned behind windows provided in the finished molding, the window size being such that a small overlap is provided in the upper surface 11 about perimeter edge portions of each reflector 18 and 19. Thereafter, the interior cavity of the pavement marker 10 can be filled with a liquified epoxy resin or other plastic which thereafter thermosets or solidifies into a solid state while the marker structure is housed in a mold. The bottom face 13 of a marker is thus concurrently formed.

Another suitable and presently preferred fabrication procedure is fully described in my copending U.S. patent application filed on even date herewith, the disclosure and contents of which are fully incorporated hereinto by reference and which is identified by docket no. EMP2.

Figure 6:
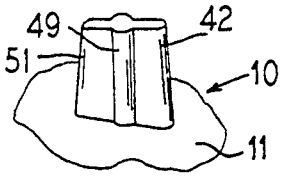
FIG. 6 is a greatly enlarged fragmentary perspective view taken in the region VI—VI of FIG. 3 showing the appearance of one presently preferred presently preferred installation tab.

One presently preferred type of tab is illustrated in FIG. 6 by tab 42. Such tab is radially elongated in width relative to depth as an above explained preference. The central portion of such tab 42, however, is provided with a generally vertically extending cylindrically thickened portion 49 which, as those skilled in the art will appreciate, can be provided by leaving out a knock out pin in one portion of a mold assembly that is being used to form the marker 10. Preferably the radially interior, upwardly extending edge 51 of tab 42 is formed as to diagonally extend in a direction diverging from the axis 14 for reasons of facilitating easy mold release, as those skilled in the art will appreciate.

As is normal in the pavement marker art, a pavement marker of the invention need have no associated reflector at all. For example, it is common practice to locate one or a series of successive pavement markers each having no reflector between a spaced pair of reflectorized pavement markers along a roadway. To achieve such an unreflectorized pavement marker structure, a pavement marker can be structured as described above in relation to marker 10, but without any reflector at all. The result is a pavement marker embodiment 52 of this invention whose upper surface 53 is generally spherically convexly curved as shown in FIG. 7. The surface 53 is provided either with a pair of tabs 54 and 56 which can be similar in structure and position to tabs 41 and 42, or with a tab 50 alternatively.

Figure 8:
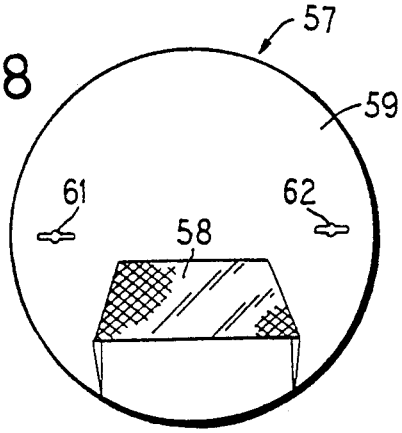
FIG. 8 is a view similar to FIG. 4 but showing another alternative embodiment of a pavement marker.

Also, as those skilled in the art will appreciate, a pavement marker of the invention can have only a single reflector element which is viewable from one general approach direction only. Such a pavement marker embodiment 57 of this invention is shown in FIG. 8. Such a marker 57 is structured as described above in relation to marker 10, but incorporates only a single recessed reflector 58 which can correspond to either reflector 18 or 19. The result is the pavement marker 57 which has a convexly rounded top surface 59 except on the reflector 58 that is inset thereinto. The rounded surface 59 is provided with tabs 61 and 62 that are similar to tabs 41 and 42 and the tabs 54 and 56.

The pavement markers 10, 52 and 57 preferably consist of a molded plastic shell and core and are particularly well adopted for use as temporary raised pavement markers in road construction zones and the like.

Preferably, a pavement marker body is comprised of a molded plastic such as ABS (acrylonitrile/-butadiene/styrene), polycarbonate, methylmethacrylate, or the like, and preferably a reflex reflector is comprised of a clear molded plastic such as methyl methacrylate or other acrylic resin. If a reflector is associated with a body the reflector as preferably mechanically sealed to the body around the reflector periphery by encapsulation between the marker body housing and core assembly to eliminate the entrance of moisture and dirt. The face of the reflex reflector is preferably flat and smooth. Preferably the face of the reflex refection is recessed into the marker body at least about 0.156 inch (3.97 mm) to protect it from direct contact with vehicle tires. The body is preferably white or yellow and the reflex reflector is either colorless or tinted yellow in color. The body is preferably compatible with all commercial pavement marker adhesives, including tar (bitumous) butyl-type, epoxy type, and the like. Both the marker body and the reflectors mounted thereon are preferably each comprised of, UV stabilized plastics to resist sun fade.

Since other and further embodiments and features will be apparent to those skilled in the art from these teachings of the present invention, no undue limitations are to be drawn therefrom.

What is claimed is:

1. A pavement marker comprising a solid flattened body comprised of plastic and having
- a perimeter,
- a generally convex top, and
- a generally planar bottom; and tab means
- said tab means being integral with and outstanding from said top, and in inwardly spaced relationship to said perimeter,
- said tab means being cooperatively engagable at outer regions thereof by clamping between a thumb tip and at least one finger tip of a hand so that said body is supportable by compression force exerted between said thumb and said finger(s), said tab means being relatively rigid in the direction of said compression force, and
- said tab means also being brittle and breakable adjacent said top responsive to a relatively small bending force applied against said outer regions in a different direction from that in which said compression force is exerted.

2. The pavement marker of claim 1 wherein said perimeter is convexly curved.

3. The pavement marker of claim 2 wherein said perimeter is circular, and said body has a vertical central axis and a maximum thickness in the region in said central axis.

4. The pavement marker of claim 3 wherein said body is provided with a first prismatic reflex reflective lens that is inset into said top and that reflects incident light from one direction, and wherein said tab means comprises a pair of spaced tabs.

5. The pavement marker of claim 4 which is additionally provided with a second prismatic reflex reflective lens that is insert into said top and that reflects incident light from an opposite direction.

6. The pavement marker of claim 5 wherein said tab means is located between said first and said second prismatic reflective lenses.

7. A pavement marker comprising a solid flattened body comprised of molded thermoplastic and having generally convex top, a perimeter, and a generally planar bottom; and a pair of tabs, each one having a base end that is integral with said top and that is located inwardly spaced relationship to said perimeter and an opposed outstanding outer end region;

each tab being in spaced relationship relative to the other thereof, each tab being engagable at said outer end region thereof with a different one of a thumb tip and a forefinger tip of a hand so that said body is supportable by compression force exerted between said thumb and said forefinger, said tab means being relatively rigid in the direction of said compression force, and being breakable at said base end adjacent said top responsive to a relatively small bending force applied against said outer end region in a direction generally normal to the direction in which said compression force is exerted.

8. The pavement marker of claim 7 wherein said perimeter is circular.

9. The pavement marker of claim 8 wherein said perimeter is circular and said body has a vertical central axis and a maximum thickness in the region in said central axis and said tabs are located approximately along a body diameter in radially spaced relationship relative to said axis.

10. The pavement marker of claim 9 wherein said tabs are located approximately in aligned relationship to a first horizontally extending diameter that extends through said central axis with one said tab being located on each side of said central axis and generally equally spaced from said perimeter.

11. The pavement marker of claim 10 which is provided with a first planar faced prismatic lenticular reflex reflective lens that is inset into said top and that also is peripherally overlapped by said body, said lens being inclined so as to be retro-reflective of incident light originating within an effective projected vertical reflex angle that extends from about a horizontal ground line upwards to a maximum vertical angle that is not more than about 0.5 degrees and within an effective projected horizontal reflex angle that extends at least about 1 degree on either side of a second horizontally extending diameter that extends perpendicularly through a center line extending horizontally across said planar lens face.

12. The pavement marker of claim 11 wherein said vertical reflex angle is about 0.2 degrees and each of said horizontal reflex angles is identical to the other thereof and each falls in the range of about 1.5 to about 3 degrees.

13. The pavement marker of claim 11 wherein said second diameter is oriented normally to said first diameter.

14. The pavement marker of claim 11 which is provided with a second planar faced prismatic reflex reflective lens that is inset into said top that also is peripherally sealed to said body and that is similarly so inclined but in opposed relationship to said first lens, thereby to reflect incident light originating from an opposite direction, said second diameter also extending perpendicularly through a center line extending horizontally across said second lens.

15. The pavement marker of claim 14 wherein said second diameter is oriented normally to said first diameter.

16. The pavement marker of claim 7 wherein said bottom is provided with surface irregularities for augmenting bottom bondability to an adhesive.

17. The pavement marker of claim 10 wherein said pattern comprises a plurality of spaced, shallow, discretely formed projecting feet.

18. The pavement marker of claim 7 wherein each said tab has a width which is elongated in the general direction wherein said compression force is to be exerted and a breadth which is substantially less than said width thereby to aid said breakability in response to said applied bending force.

* * * * *